US008826625B2

(12) United States Patent
Colton

(10) Patent No.: US 8,826,625 B2
(45) Date of Patent: Sep. 9, 2014

(54) FASTENER TO SECURE REBAR RODS AND ASSOCIATED METHODS

(75) Inventor: Michael R. Colton, Bellaire, TX (US)

(73) Assignee: Rebarb, L.L.C., Houston, TX (US)

( * ) Notice: Subject to any disclaimer, the term of this patent is extended or adjusted under 35 U.S.C. 154(b) by 2 days.

(21) Appl. No.: 13/574,190

(22) PCT Filed: Jan. 28, 2011

(86) PCT No.: PCT/US2011/022879

§ 371 (c)(1),
(2), (4) Date: Sep. 6, 2012

(87) PCT Pub. No.: WO2011/094509

PCT Pub. Date: Aug. 4, 2011

(65) Prior Publication Data

US 2012/0317921 A1 Dec. 20, 2012

Related U.S. Application Data

(60) Provisional application No. 61/299,873, filed on Jan. 29, 2010.

(51) Int. Cl.
*E04B 1/41* (2006.01)
*E04C 5/16* (2006.01)

(52) U.S. Cl.
CPC ..... *E04C 5/163* (2013.01)
USPC ..... 52/712; 52/699; 52/719; 52/745.21; 29/525.01; 24/17 A

(58) Field of Classification Search
USPC ..... 52/712, 715, 719, 685, 686, 699, 52/745.21; 24/16 PB, 17 A, 22, 23 B; 248/74.3, 74.2; 29/525.01, 433, 452, 29/450
See application file for complete search history.

(56) References Cited

U.S. PATENT DOCUMENTS

| | | | | |
|---|---|---|---|---|
| 1,001,209 A | | 8/1911 | Miller | |
| 1,149,648 A | * | 8/1915 | Henderson | 52/719 |
| 1,213,919 A | * | 1/1917 | Symons | 52/685 |
| 1,512,763 A | * | 10/1924 | Holmgreen | 52/669 |
| 1,592,479 A | * | 7/1926 | Williams | 24/20 EE |

(Continued)

FOREIGN PATENT DOCUMENTS

| | | |
|---|---|---|
| CN | 201212213 | 3/2009 |
| GB | 1123931 A | 8/1968 |
| WO | 2006043039 A1 | 4/2006 |

OTHER PUBLICATIONS

PCT International Search Report (PCT/US2011/022879), dated Jun. 6, 2011.

*Primary Examiner* — Brian Glessner
*Assistant Examiner* — Jessie Fonseca
(74) *Attorney, Agent, or Firm* — Bracewell & Giuliani LLP

(57) ABSTRACT

A fastener for securing rebar rods that is a generally planar, elongated main body selectively deformed into a closed loop. The fastener can also include a head end integrally formed with the main body having a buckle and an opening. A tail end depends from the main body that has a plurality of substantially flat, spaced-apart, and staggered engaging members, or barbs. The rods are secured by folding the tail end around the rods and inserting the tail end into the opening of the buckle and twisting the tail end so that a barb engages an edge of the buckle.

21 Claims, 7 Drawing Sheets

(56) References Cited

U.S. PATENT DOCUMENTS

| | | | | | |
|---|---|---|---|---|---|
| 1,810,027 | A | * | 6/1931 | Moran et al. | 24/17 R |
| 2,153,227 | A | * | 4/1939 | Allstatter | 40/668 |
| 2,961,785 | A | * | 11/1960 | Toepfer | 40/669 |
| 3,653,099 | A | * | 4/1972 | Hoffman | 24/16 PB |
| 3,694,863 | A | * | 10/1972 | Wasserlein, Jr. | 24/16 PB |
| 3,913,179 | A | * | 10/1975 | Rhee | 24/16 PB |
| 3,922,758 | A | * | 12/1975 | Wunnenberg et al. | 24/16 PB |
| 4,096,680 | A | * | 6/1978 | Ritter et al. | 52/665 |
| 4,477,950 | A | * | 10/1984 | Cisek et al. | 24/30.5 P |
| 4,676,535 | A | * | 6/1987 | Mautner | 292/320 |
| 5,502,877 | A | * | 4/1996 | Yocum | 24/16 PB |
| 5,642,554 | A | * | 7/1997 | Sorensen et al. | 24/16 PB |
| 5,792,409 | A | * | 8/1998 | Sorensen et al. | 264/297.2 |
| 5,836,053 | A | * | 11/1998 | Davignon et al. | 24/16 PB |
| 5,881,460 | A | * | 3/1999 | Nowell et al. | 29/897.34 |
| 5,911,368 | A | * | 6/1999 | Davignon | 24/16 PB |
| 5,924,171 | A | * | 7/1999 | Sorensen et al. | 24/16 PB |
| 7,377,013 | B2 | * | 5/2008 | Cheung | 24/16 PB |
| 7,377,083 | B2 | * | 5/2008 | McCafferty et al. | 52/719 |
| 8,112,964 | B2 | * | 2/2012 | Baruh | 52/719 |
| 8,302,264 | B2 | * | 11/2012 | Shigematsu et al. | 24/16 PB |
| 2001/0050325 | A1 | * | 12/2001 | Dunay et al. | 248/74.3 |
| 2002/0194809 | A1 | * | 12/2002 | Schulze et al. | 52/712 |
| 2005/0115028 | A1 | * | 6/2005 | Cheung | 24/16 PB |

* cited by examiner

FASTENER TO SECURE REBAR RODS AND ASSOCIATED METHODS

BACKGROUND OF THE INVENTION

1. Field of Invention

The present invention relates generally to the construction industry, and, more particularly, to fasteners and associated methods to fastening reinforcement steel rebar rods.

2. Description of the Related Art

Concrete is an artificial, stone-like material used for various structural purposes, made by mixing cement and various aggregates, such as sand, pebbles, gravel, or shale, with water and allowing the mixture to harden. It is well known that concrete is strong in compression but relatively weak in tension. Reinforced concrete and reinforced masonry structures are extremely common, including in highway and roadway construction. Reinforced concrete is concrete containing iron or steel bars, strands, or mesh to absorb tensile and shearing stresses. Reinforcement steel rods, typically known as rebar rods, are usually formed from carbon steel and have ridges for better mechanical anchoring into the concrete. Steel and concrete have similar coefficients of thermal expansion so that temperature changes result in minimal stress for concrete structures reinforced with steel rods. Rebar rods come in different sizes, including in metric and standard United States units.

Typically, rebar rods are tied together and positioned in the structure's form prior to pouring the concrete. Rebar rods are commonly tied by hand. In the pigtail method, the worker uses precut wire and a twisting tool that looks like a pig's tail. In the pliers method, the worker uses a spool of wire and a pliers tool. These methods subject workers to physical risks and especially repetitive bending down to tie the rebar rods together. Workers can also connect rebar rods together using plastic spacers, rebar staples, and plastic cable ties, each of which has its drawbacks in addition to subjecting workers to physical risks and repetitive bending down. Plastic spacers, also called couplers, are generally expensive. Plastic spacers introduce another material into the reinforced concrete, and that material may not have the favorable thermal properties with respect to concrete that steel does. Rebar rods connected by plastic spacers may not be as strong as rebar rods connected by wire. Plastic spacers come in various sizes, and a given plastic spacer may be limited to a particular rebar rod size or range of sizes. Likewise, rebar staples come in various sizes, and a given rebar staple may be limited to a particular rebar rod size or range of sizes. If incorrectly sized, a too-large rebar staple can extend beyond the concrete. Like plastic spacers, plastic cable ties introduce another material and its associated thermal properties into the reinforced concrete.

In addition, automatic tying and fastening tools have been introduced into the market.

SUMMARY OF INVENTION

In view of the foregoing, Applicant has recognized one or more sources of the problems with the prior art approaches. For example, prior art methods subject workers to physical risks and especially repetitive bending down to tie the rebar rods together. For example, the labor associated with plastic spacers, rebar staples, and plastic cable ties can be greater than the common pigtail and pliers methods in terms of both time and money. For example, plastic spacers, rebar staples, and plastic cable ties are typically limited to specific sizes of rebar rods, resulting in inventory and logistics complications. A particular problem can be a fastener that extends outside the frame of the concrete. Applicant submits that a source of this problem is the use of an incorrectly sized fastener (e.g., a fastener used with rebar rods that are too small). For example, various prior art approaches do not provide a consistent taut fit; that is, fasteners can relax or stretch immediately after fastening or over time so that rebar rods can shift, affecting the tensile strength of the reinforced concrete. Applicant submits that the improved locking mechanism enhancements described herein provide for a sustained taut fit. Accordingly, embodiments of the present invention, for example, provide a fastener to secure at least two reinforcement steel rebar rods and associated methods.

Embodiments of the present invention include a method of using a fastener to secure at least two reinforcement steel rebar rods. The method can include positioning at least two reinforcement steel rebar rods adjacent each other. The reinforcement steel rebar rods typically intersect at 90 degree angles (as illustrated in FIG. 1). The method can include folding the fastener around the positioned reinforcement steel rebar rods. The fastener can include, for example, a head end and a tail end. The head end of the fastener can include a buckle; the buckle can include a frame adjacent and surrounding an opening formed in the buckle. The tail end of the fastener can include a plurality of substantially flat, spaced-apart, and staggered engaging members defining a plurality of barbs. The method of using the fastener can then include inserting the tail end of the fastener into the opening formed in the buckle of the head end of the fastener. The method can further include twisting rotationally with respect to an axis of the main body of the fastener the tail end of the fastener so that the tail end of the fastener engages an edge of the frame of the buckle of the head end of the fastener (typically a transverse edge but also a lateral edge or both) through one of the plurality of barbs to form a closed loop to thereby secure the at least two reinforcement steel rebar rods within the closed loop. In a preferred embodiment, a quarter-twist, i.e., a twist of 90 degrees, is employed, although those skilled in the art will recognize that other ranges of rotation are within the scope of the embodiments of the present invention.

Embodiments of the present invention can also include a fastener to secure at least two reinforcement steel rebar rods. The fastener embodiments can include a substantially flat, elongated main body to be folded upon itself to form a closed loop. The main body can have having a first end portion, a second end portion, and an axis substantially parallel to a length of the elongated main body.

The fastener embodiments can also include a substantially flat buckle integrally formed with the first end portion of the main body so that the first end portion of the main body and the buckle together define a head end of the fastener. The buckle can include a frame adjacent and surrounding an opening formed in the buckle.

The fastener embodiments can also include a plurality of substantially flat and spaced-apart engaging members. Each engaging member is connected to and extends outwardly in a lateral direction from the second end portion of the main body. Each engaging member respectively has a head edge positioned closer to the head end of the fastener and a tail edge substantially parallel to the head edge and positioned farther from the head end of the fastener than the head edge so that the plurality of engaging members define a plurality of barbs. The head edge of each of the plurality of barbs extends outwardly at a predefined angle less than 90 degrees from the axis. The barbs, for example, can resemble or inspire thoughts of the barbs of a stingray. The plurality of barbs can be staggered on opposite lateral sides of the main body so that the second end portion of the main body and the plurality of barbs together define a tail end of the fastener. According to an embodiment of the present invention, when folded to substantially surround the at least two reinforcement steel rebar rods, the tail end of the fastener can insert into the opening formed in the buckle of the head end of the fastener; when twisted rotationally with respect to the axis, the tail end then engages an edge of the frame of the buckle through one of the plurality of barbs to form the closed loop to thereby secure the at least two reinforcement steel rebar rods within the closed loop. The purpose of staggered barbs includes a tighter granularity of fit (i.e., twice the granularity compared with barbs on only one side of the fastener) and also the ability to undulate the tail end through the opening formed in the buckle of the head end of the fastener, which allows for a smaller and tighter opening.

In addition, the main body of the fastener can also include a third portion positioned between the first end portion and second end portion defining a medial portion. Within the medial portion, the fastener can also include first and second substantially flat aligning tabs, each being connected to and extending outwardly in opposite lateral directions from a section of the medial portion of the main body so that the first and second aligning tabs and an integrally formed section of the medial portion together define a guide member. One purpose of the guide member is to assist or guide the user when locating the fastener on the reinforcement steel rebar rods so that the fastener can surround the rods with the tail end not extending beyond an upper portion reinforcement steel rebar rods. That is, the guide member can position the fastener so that the fastener, when folded, remains within the frame of the concrete. The fastener embodiments should not poke out of the concrete form. A second purpose of the guide member is to allow a fastener applying tool to apply the fastener automatically (i.e., not manually), repetitively and efficiently. That is, the guide member may be engaged, grasped, clasped, or otherwise used by a fastener applying tool.

Example embodiments of a fastener optionally provide for multiple openings formed in the buckle of the head end. An additional opening can serve at least two purposes. First, an additional opening can provide for various sizes of reinforcement steel rebar rods, analogous to additional notches on a belt to hold up various sizes of pants. That is, different openings can support different sizes of reinforcement steel rebar rods. Second, an additional opening in the head end of a fastener can allow for a fastener applying tool to grasp, clasp, align, or other use the fastener to secure automatically (i.e., not manually) reinforcement steel rebar rods. As understood by those skilled in the art, an example fastener embodiment may have three (or more) openings, one (or more) opening for use by a fastener applying tool and two (or more) openings to accept the tail end.

The features and benefits of the embodiments of a fastener as described herein include structures that enable a fastener applying tool to secure automatically reinforcement steel rebar rods. A fastener applying tool using the fastener embodiments of the present invention has improved ergonomics over manual solutions, increased efficiency, and the ability to repetitively and serially apply fasteners. For example, a fastener applying tool can use the guide member and also any additional opening in the head end of the fastener to apply the fastener. For example, that the fastener can be substantially flat provides that stacks of fastener embodiments can be stored, transported to a job site, and deployed efficiently, perhaps in a cartridge or other bundling mechanism useful to an automatic fastener applying tool.

The features and benefits of the embodiments of a fastener as described herein include structures for use with a plurality of predetermined sizes of reinforcement steel rebar rods and for generating a taut fit. That is, a job site using multiple sizes of reinforcement steel rebar rods may require an inventory of only a single, or perhaps a few sizes, of fastener embodiments because of these features and embodiments. For example, the plurality of barbs of the tail end of the fastener can allow for various sizes of reinforcement steel rebar rods and also provides tolerances for the rods and their placement and positioning. For example, an additional opening in the head end of the fastener can allow for various sizes of reinforcement steel rebar rods to be secured by a fastener as described herein. For example, the guide member can allow the fastener to secure a relatively smaller size of reinforcement steel rebar rods and a relatively larger size of reinforcement steel rebar rods with the fastener not extending beyond the concrete form.

The embodiments of a fastener as described herein include that the fastener be able to bend, in order to fold around the reinforcement steel rebar rods. In addition, the embodiments of a fastener include the ability to be rotationally twisted as described herein. Moreover, the embodiments of the tail end of the fastener where the tail end engages an edge of the frame of the buckle of the head end of the fastener through one of the plurality of barbs to form a closed loop to thereby secure the at least two reinforcement steel rebar rods require a certain strength of the barb and a rigidity for the twisted main body. That is, the main body of the fastener twists to secure the closed loop, but then does not twist back, resulting in a lasting snug or taut fit. As such, fastener embodiments can include steel, coated steel, dead soft steel, other material (including ferrous and non-ferrous material), and some plastics (i.e., plastics having sufficient strength and malleability and other properties as described herein). In addition, while fastener embodiments have been described in terms of components, for example, barbs, a main body, a guide member, and head end, it will be understood by those skilled in the art that a fastener can be molded as a single body of plastic, stamped as a single body of steel, or otherwise formed as a single composition having the components described herein. Moreover, fastener embodiments include features and structures to enable such composition, such as, for example, the fastener being substantially flat or having lengths, widths, and angles as described herein.

Fastener and associated method embodiments of the present invention provide improvements and enhancements of fasteners over the prior art. In addition, embodiments of the present invention include other fasteners and associated methods to secure reinforcement steel rebar rods, as will be understood by those skilled in the art.

BRIEF DESCRIPTION OF DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Applicant has recognized one or more sources of the problems with the prior art approaches. For example, prior art methods subject workers to physical risks and especially repetitive bending down to tie the rebar rods together. For example, the labor associated with plastic spacers, rebar staples, and plastic cable ties can be greater than the common pigtail and pliers methods in terms of both time and money. For example, plastic spacers, rebar staples, and plastic cable ties are typically limited to specific sizes of rebar rods, resulting in inventory and logistics complications. A particular problem can be a fastener that extends outside the frame of the concrete. Applicant submits that a source of this problem is the use of an incorrectly sized fastener (i.e., a fastener used with rebar rods that are too small). For example, various prior art approaches do not provide a consistent taut fit; that is, fasteners can relax or stretch immediately after fastening or over time so that rebar rods can shift, affecting the tensile strength of the reinforced concrete. Applicant submits that the improved locking mechanism enhancements described herein provide for a sustained taut fit. Accordingly, embodiments of the present invention, for example, provide a fastener to secure at least two reinforcement steel rebar rods and associated methods.

Figure 1:
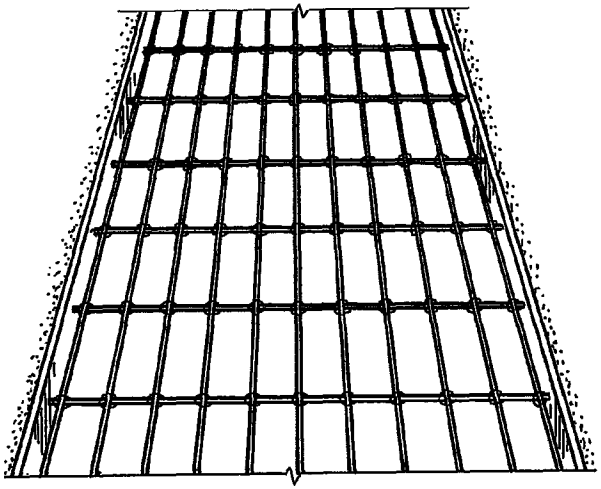
FIG. 1 is an environmental view of a highway construction project of a plurality of rebar reinforcement rods being fastened together with a fastener according to an embodiment of the present invention.
Figure 2:
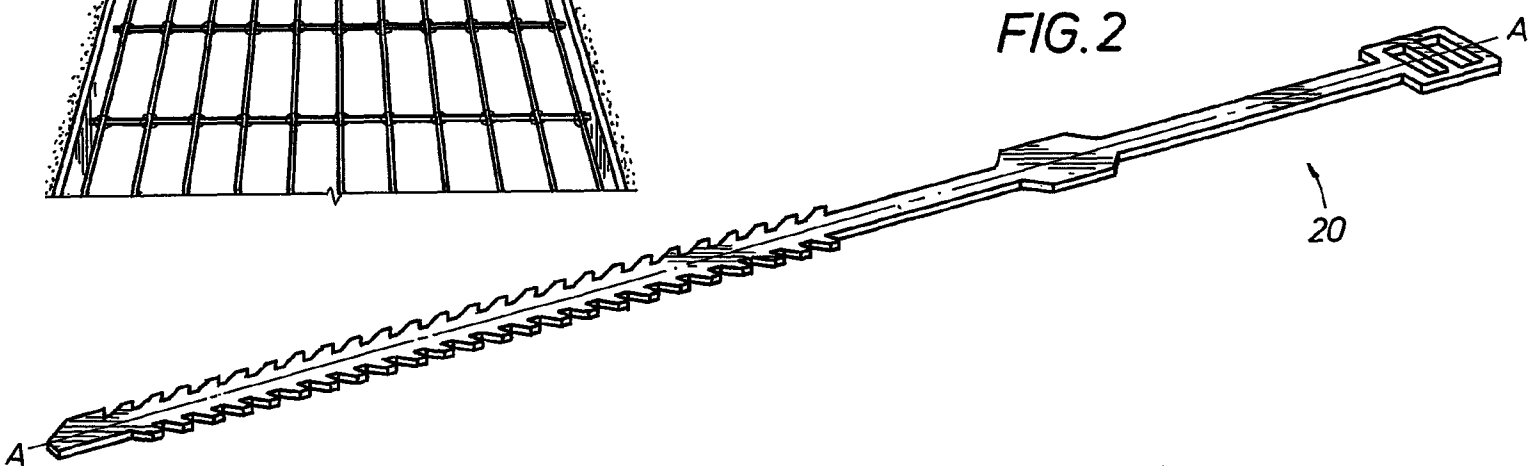
FIG. 2 is a perspective view of a fastener in a fully open position according to an embodiment of the present invention.

As illustrated in FIG. 1, a highway construction project according to an embodiment of the present invention requires numerous fasteners to secure the plurality of rebar reinforcement rods with fasteners. According to an example embodiment, each intersection of a longitudinal and transverse rebar rod is secured using a fastener, with the spacing of the rebar rods designed according to the desired tensile strength and construction codes. As understood by those skilled in the art, reinforced concrete using fasteners according to embodiments of the present invention can include slabs, parking structures, bridges, and other applications. In addition, reinforced masonry using fasteners according to embodiments of the present invention includes walls of bricks being reinforced by rebar rods.

As illustrated in FIGS. 2, 3, 4A, 4B, and 4C, embodiments of the present invention include a fastener 20. The fastener 20, shown in a fully open position in FIGS. 2, 3, 4A, 4B, and 4C, can be substantially flat. The fastener 20 can have an elongated main body 30 to be folded upon itself to form a closed loop. The body can have a first end portion, a second end portion, and an axis A substantially parallel to a length of the elongated main body 30.

According to example embodiments of a fastener, the fastener 20 can include a substantially flat buckle integrally formed with the first end portion of the main body 30 so that the first end portion of the main body 30 and the buckle together define a head end of the fastener 28. The buckle can include a frame adjacent and surrounding an opening 50 formed in the buckle. See, e.g., FIG. 4B.

According to example embodiments of a fastener, the fastener 20 can also include a plurality of substantially flat and spaced-apart engaging members 34. Each engaging member connects to and extends outwardly in a lateral direction from the second end portion of the main body 30, and each respectively has a head edge 41 positioned closer to the head end 28 of the fastener 20 and a tail edge 39 substantially parallel to the head edge 41 and positioned farther from the head end 28 of the fastener 20 than the head edge 41. The plurality of engaging members 34 can define a plurality of barbs 34. The head edge 41 of each of the plurality of barbs 34 extends outwardly at a predefined angle $\theta_1$ less than 90 degrees from the axis A. In an example embodiment, the predefined angle $\theta_1$ from the axis A for the head edge 41 of each of the plurality of barbs 34 is between about 30 and about 60 degrees. Each of the plurality of barbs 34 can also have a proximal end 38 adjacent and connected to the second end portion of the main body and a distal end 40 that is distal from the second end portion of the main body. The plurality of barbs 34 can be staggered on opposite lateral sides 46, 48 of the main body 30 so that the second end portion of the main body and the plurality of barbs together define a tail end 24 of the fastener 20. See, e.g., FIG. 4A. In a preferred embodiment, each of the plurality of barbs 34 has a substantially parallelogram shape and has rounded corners adjacent the head edge 41. The purpose of staggered barbs 34 includes a tighter granularity of fit (i.e., twice the granularity compared with barbs on only one side of the fastener) and also the ability to undulate the tail end 24 of the fastener 20 through the opening 50 formed in the buckle of the head end 28 of the fastener 20, which allows for a smaller and tighter opening.

When folded to substantially surround the at least two reinforcement steel rebar rods 74, the tail end 24 of the fastener 20 inserts into the opening 50 formed in the buckle of the head end 28 of the fastener 20. And when twisted rotationally with respect to the axis A, the tail end 24 engages an edge of the frame, typically a transverse edge 62 but also a lateral edge 60 or both, of the buckle of the head end 28 of the fastener 20 through one of the plurality of barbs 34 to form the closed loop to thereby secure the at least two reinforcement steel rebar rods 74 within the closed loop.

Figure 4A:
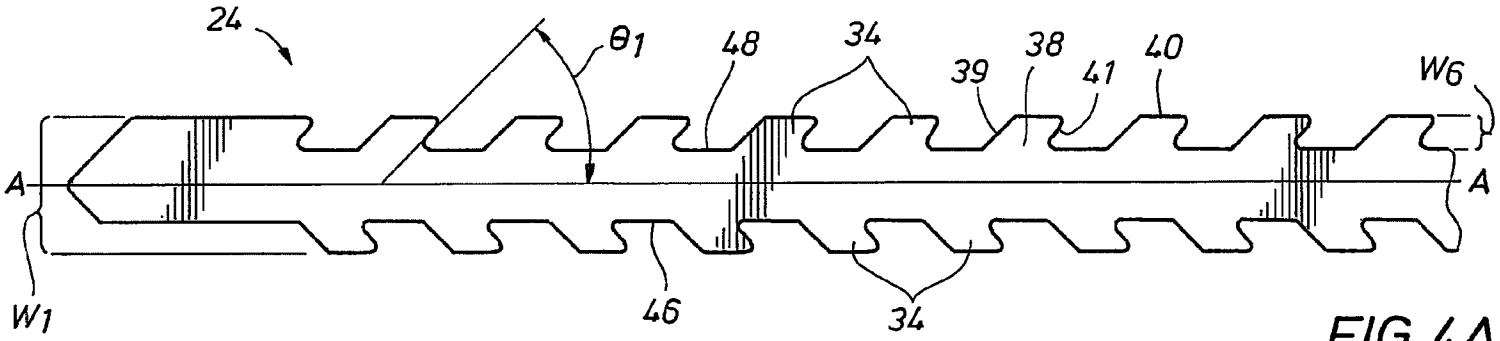
FIG. 4A is an enlarged and fragmented view of a tail end of a body of a fastener according to an embodiment of the present invention.

According to example embodiments of a fastener, the tail width can be defined as a first width $W_1$ for the tail end 24 of the fastener 20. The tail width $W_1$ of the fastener 20 can extend in a lateral direction from the distal end 40 of a first barb 34 to the distal end 40 of a second barb 34, where the second barb is positioned on an opposite lateral side of the main body from the first barb. See, e.g., FIG. 4A. According to example embodiments of a fastener 20, an opening width can be defined as a second width $W_2$ for the opening 50 formed in the buckle in the head end 28 of the fastener 20. The opening width $W_2$ of the fastener 20 can extend from a first lateral edge 60 of the frame adjacent the opening 50 to a second lateral edge 60 of the frame being positioned on an opposite lateral side of and adjacent the opening 50. See, e.g., FIG. 4B. The opening width $W_2$ of the fastener 20 can exceed the tail width $W_1$ so that the tail end 24 of the fastener 20 inserts into the opening 50 formed in the buckle of the head end 28 of the fastener 20. See, e.g., FIG. 5C. In addition, as illustrated in FIG. 4A, a barb width can be defined as a sixth width $W_6$ for a barb 34 of the tail end 24 of the fastener 20. The barb width $W_6$ can extend in a lateral direction from the distal end 40 to the proximal end 38 of a barb 34.

According to example embodiments of a fastener, an opening length can be defined as a first length $L_1$ for the opening 50 formed in the buckle in the head end 28 of the fastener 20. The opening length $L_1$ can extend from a first edge 62 of the frame transverse the axis A and adjacent the opening 50 to a second edge 62 of the frame transverse the axis, adjacent the opening 50, and opposite the first edge. See, e.g., FIG. 4B. The tail width $W_1$ can exceed the opening length $L_1$ so that when inserted in the head end 28 of the fastener 20 and then twisted rotationally with respect to the axis A, the tail end 24 of the fastener 20 engages the head end 28 of the fastener 20 to thereby prevent a withdraw of the tail end 24. See, e.g., FIGS. 5E and 5F.

Figure 5G:
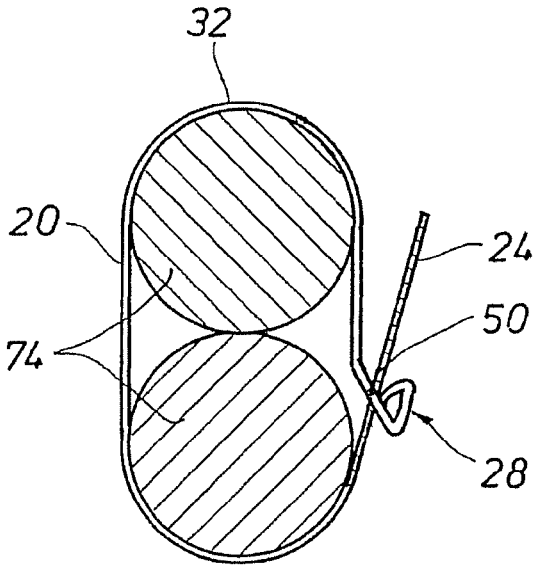
FIG. 5G is a fragmentary perspective view of a fastener having a head end being operationally twisted with respect to a tail end when in a closed loop position according to an embodiment of the present invention.
Figure 5A:
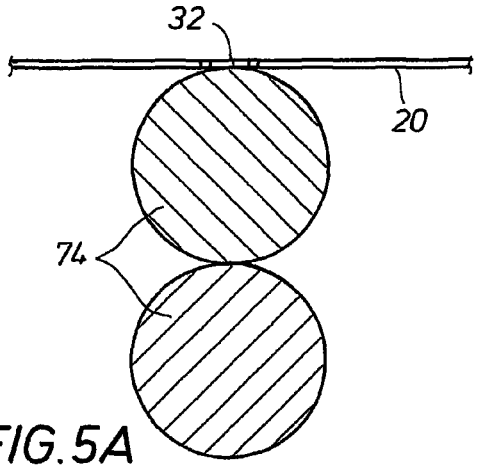
FIG. 5A is a front plan view of a fastener in an open position prior to being positioned on a pair of rebar rods as illustrated by sectional views thereof according to an embodiment of the present invention.
Figure 5B:
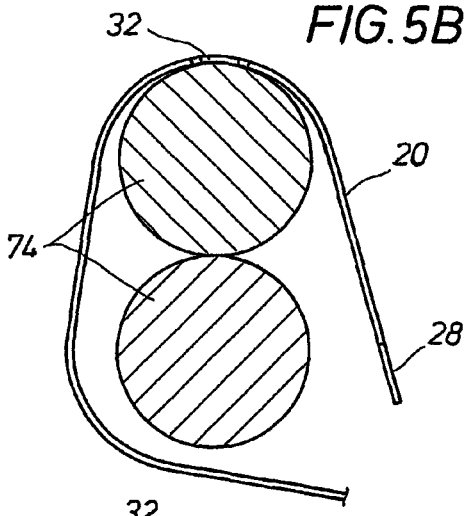
FIG. 5B is a front plan view of a fastener being positioned to substantially surround the pair of rebar rods of FIG. 5A according to an embodiment of the present invention.
Figure 5C:
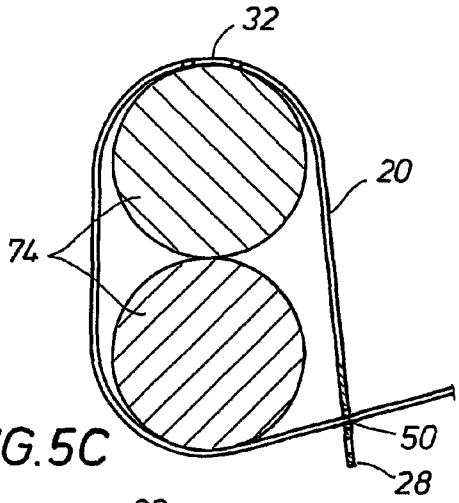
FIG. 5C is a front plan view of a fastener being positioned to surround the pair of rebar rods of FIGS. 5A and 5B to form a closed position according to an embodiment of the present invention.
Figure 5D:
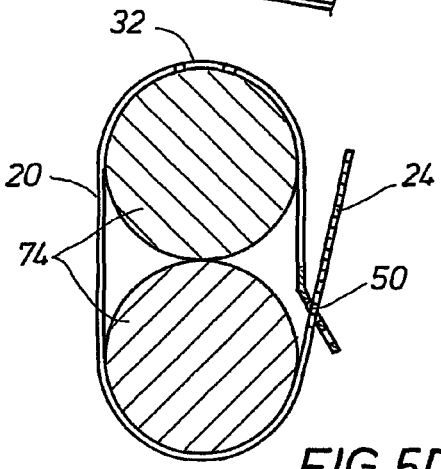
FIG. 5D is a front plan view of a fastener being positioned to surround the pair of rebar rods of FIGS. 5A, 5B, and 5C to form a closed position and being prepared to lock in a fully engaged position according to an embodiment of the present invention.
Figure 5E:
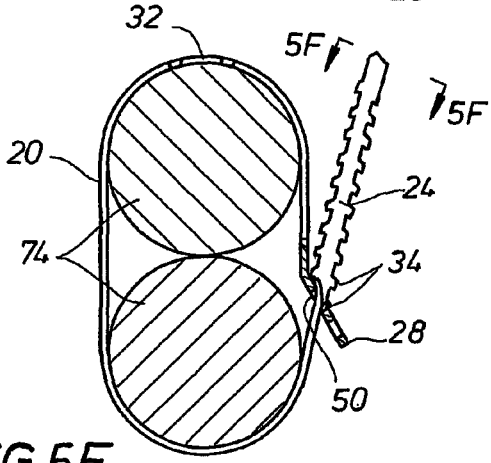
FIG. 5E is a front plan view of a fastener being positioned to surround the pair of rebar rods of FIGS. 5A, 5B, 5C and 5D when locked in a fully engaged position according to an embodiment of the present invention.
Figure 5F:
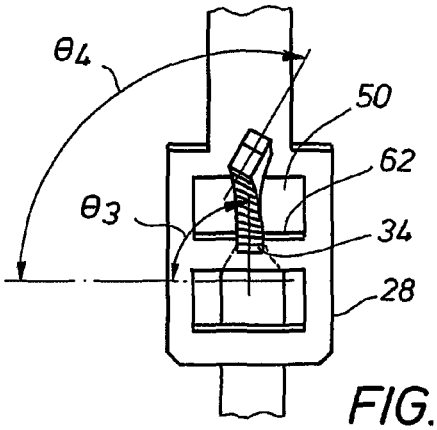
FIG. 5F is a fragmentary perspective view of a fastener having a tail end being operationally twisted with respect to a head end when in a closed loop position according to an embodiment of the present invention.

According to example embodiments of a fastener, as illustrated in FIG. 5F, the tail end 24 being twisted rotationally with respect to the axis A can be rotated between about plus or minus 30 degrees and 105 degrees at the one of the plurality of barbs of the tail end 24 of the fastener 20 that engages the edge (typically a transverse edge 62, but also a lateral edge 60, or both 60, 62) of the frame of the buckle of the head end 28 of the fastener 20 to form the closed loop. That is, the rotation angle $\theta_3$ for the tail end 24 as measured at the tail end at the point of engagement can be between about plus or minus 30 and 105 degrees, or between about plus or minus 45 and 90 degrees with a tolerance of 15 degrees. As understood by those skilled in the art, 90 degrees is also a quarter-twist. As understood by those skilled in the art, the rotation angle $\theta_4$ for the tail end 24 as measured at the tail end 24 at a point more distal from the head end 28 of the fastener 20 can be greater than rotation angle $\theta_3$ for the tail end 24 as measured at the point of engagement. As understood by those skilled in the art, a barb 34 can be deformed in the process of twisting with respect to the axis A and engaging the edge 60, 62 of the frame of the buckle of the head end 28. As understood by those skilled in the art, over rotation, i.e., rotating beyond the about 105 degrees (being about 90 degrees plus a tolerance of 15 degrees) can result in unnecessary stress on the fastener and can affect the integrity of the fastener or the fit depending on the materials employed for the fastener. Optionally, as shown in a side partial sectional view in FIG. 5G, the head end 28 of the fastener 20 may be twisted while the tail end 24 is inserted through an opening 50. The possible angles the head end 28 can be twisted, and tolerances, include those described above with regard to the tail end 24.

Figure 3:
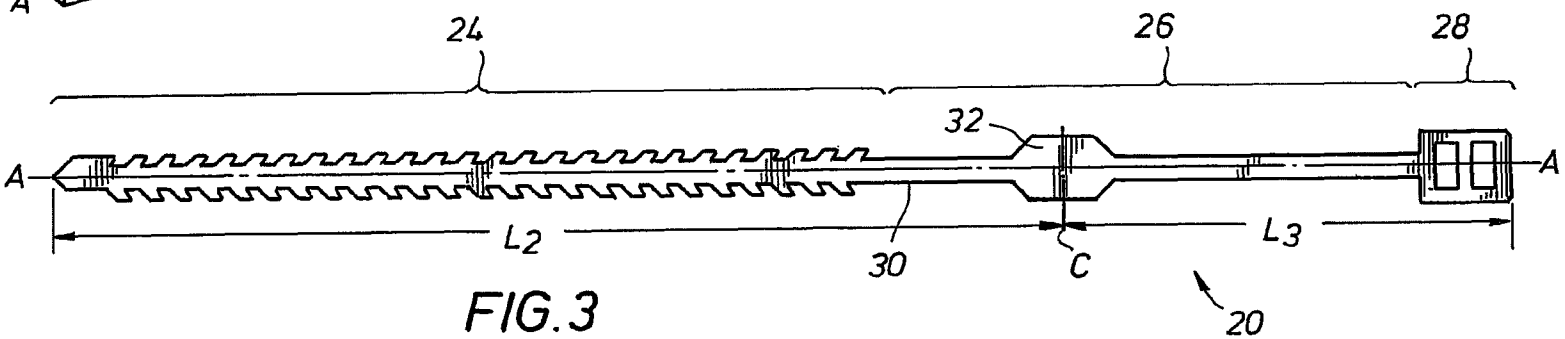
FIG. 3 is top plan view of a fastener in a fully open position according to an embodiment of the present invention.
Figure 4B:
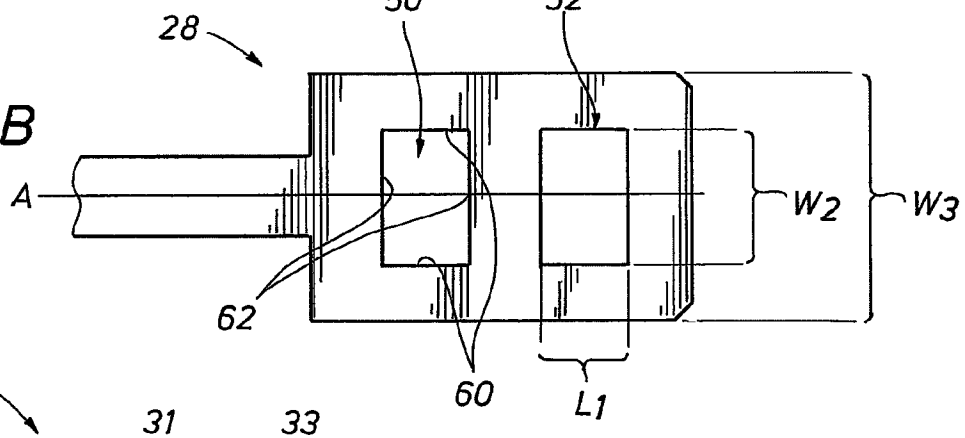
FIG. 4B is an enlarged and fragmented view of a head end of a body of a fastener according to an embodiment of the present invention.
Figure 4D:
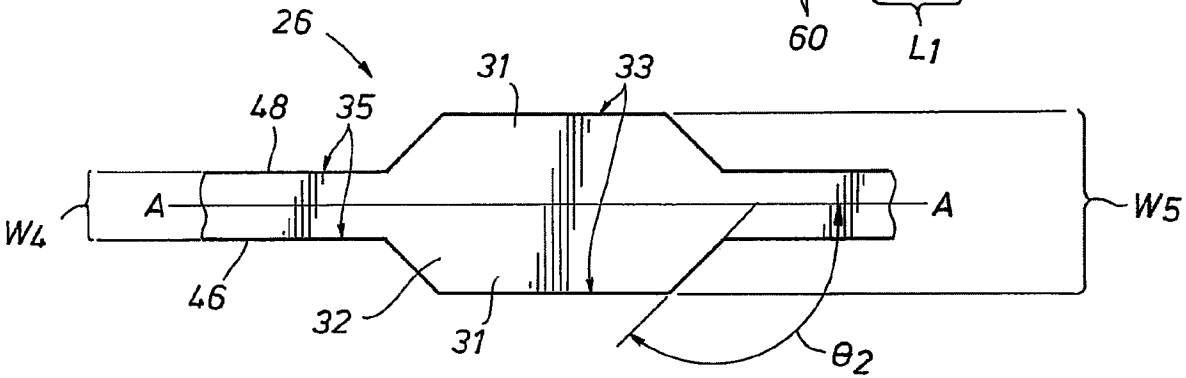
FIG. 4D is an enlarged and fragmented view of a medial portion of a body of a fastener according to an embodiment of the present invention.
Figure 4C:
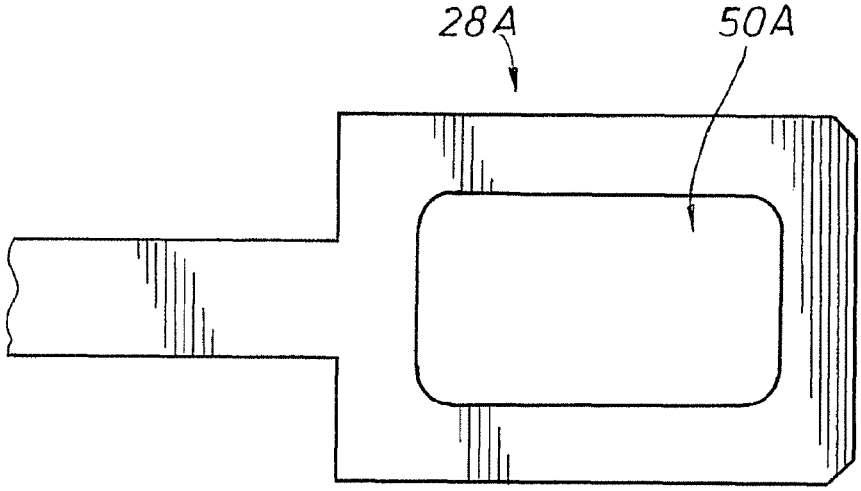
FIG. 4C is an enlarged and fragmented view of a head end of a body of a fastener according to an embodiment of the present invention.

According to example embodiments of a fastener, as illustrated in FIGS. 3 and 4C, the main body 30 of fastener 20 can also include a third portion positioned between the first end portion and second end portion defining a medial portion 26. Within the medial portion 26, the fastener can also include first and second substantially flat aligning tabs 31. Each of the aligning tabs 31 can have a proximal end 35 adjacent and connected to the medial portion of the main body 30 and a distal end 33 being distal from the medial portion of the main body 30. Each aligning tab 31 can be connected to and extending outwardly in opposite lateral directions from a section of the medial portion 26 of the main body 30 so that the first and second aligning tabs 31 and an integrally formed section of the medial portion together define a guide member 32. One purpose of the guide member 32 is to assist or guide the user when locating the fastener 20 on the reinforcement steel rebar rods 74 so that the fastener can surround the rods with the tail end 24 not extending beyond an upper portion U of the reinforcement steel rebar rods. See, e.g. FIGS. 7A and 7B. That is, the guide member 32 can position the fastener 20 so that the fastener remains within the frame of the concrete. The fastener embodiments should not poke out of the concrete form. A second purpose of the guide member 32 is to allow a fastener applying tool to apply the fastener 20 automatically (i.e., not manually), repetitively and efficiently. That is, the guide member may be engaged, grasped, clasped, or otherwise used by a fastener applying tool.

According to example embodiments of a fastener, as illustrated in FIG. 4D, a fourth width $W_4$ for the medial portion of the main body extends in a lateral direction from a first lateral edge 46 of medial portion 26 to a second lateral edge 48 of the medial portion 26 positioned on an opposite lateral side to thereby define a medial width $W_4$. A fifth width $W_5$ for the guide member 32 extends in a lateral direction from the distal end 33 of an aligning tab 31 to a distal end 31 of the opposite aligning tab to thereby define a guide width $W_5$. The guide width $W_5$ can exceed the medial width $W_4$. Thus, the guide member 32 provides additional strength compared to the main body 30. In an alternate embodiment, the medial portion of the main body 30 between the guide member 32 and the head end 28 can have the same width as the guide member 32, i.e., $W_5$ and not $W_4$, to reduce the number of cuts (or equivalent) necessary to form the fastener 20. In this alternate embodiment, the segment identified by length $L_3$ for the main body has width $W_5$.

As illustrated in FIGS. 5A-5F, embodiments of the present invention provide, for example, a method of using a fastener 20 to secure at least two reinforcement steel rebar rods 74. As illustrated in FIG. 5A, the method can include positioning the at least two reinforcement steel rebar rods 74 adjacent each other. As illustrated in FIG. 5B, the method can include folding the fastener 20 around the positioned reinforcement steel rebar rods 74. As illustrated in FIGS. 5A and 5B, this step can also include locating the guide member 32 at an upper portion U of the positioned reinforcement steel rebar rods 74 so that when folded to substantially surround the at least two reinforcement steel rebar rods 74, the tail end 24 of the fastener 20 extends below the upper portion U of the positioned reinforcement steel rebar rods 74 for a predetermined plurality of sizes of reinforcement steel rebar rods 74, 76. See, e.g., FIGS. 7A and 7B. As illustrated in FIG. 5C, the method can include inserting the tail end 24 of the fastener 20 into the opening 50 formed in the buckle of the head end 28 of the fastener 20. As illustrated in FIG. 5D, the method can include establishing a taut or snug fit through pulling tight the tail end 24 of the fastener 20. As illustrated in FIGS. 5E and 5F, the method can include twisting rotationally with respect to the axis A the tail end 24 of the fastener 20 so that the tail end 24 engages an edge 60, 62 of the frame of the buckle of the head end 28 of the fastener 20 through one of the plurality of barbs 34 to form a closed loop to thereby secure the at least two reinforcement steel rebar rods 74 within the closed loop. The tail end 24 of the fastener 20 engages the head end 28 of the fastener 20 to thereby prevent a withdraw of the tail end 24.

Figure 6:
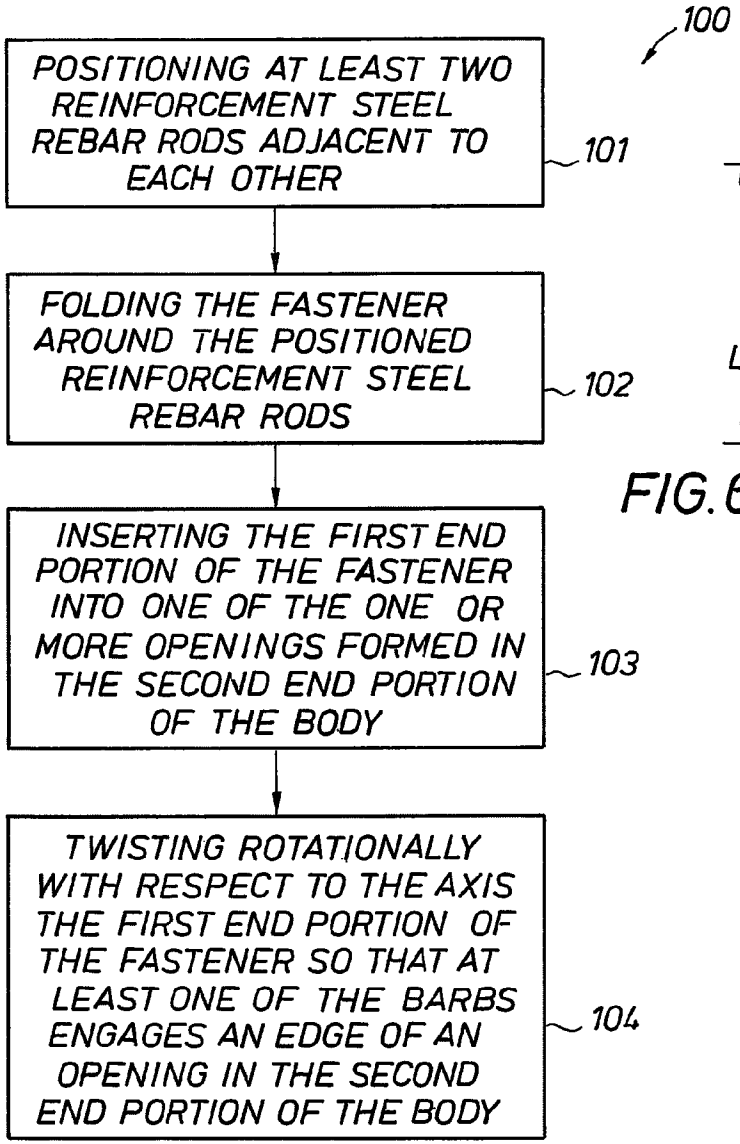
FIG. 6 is a flowchart of a process of fastening a fastener to two or more rebar rods according to an embodiment of the present invention.
Figures 8, 13, 14:
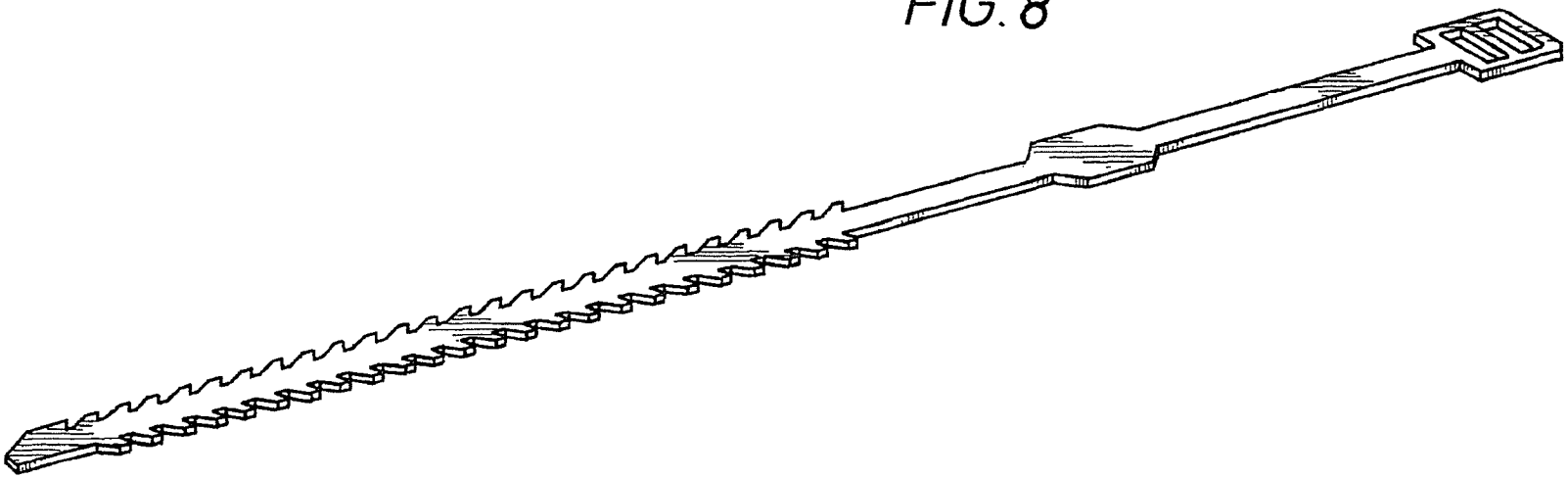
FIG. 8 is a perspective view of the fastener according to an embodiment of the present invention.
FIG. 13 is a right side elevation view of the design of FIG. 8.
FIG. 14 is a left side elevation view of the design of FIG. 8.
Figure 10:
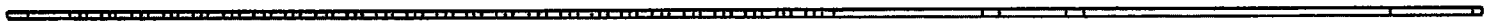
FIG. 10 is a rear elevation view of the design of FIG. 8.
Figure 9:
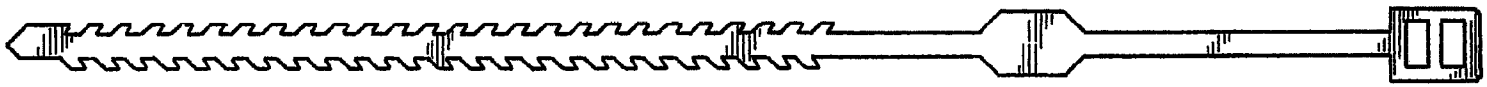
FIG. 9 is a top plan view of the design of FIG. 8.
Figure 11:
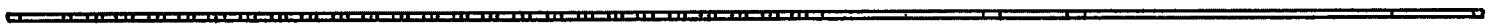
FIG. 11 is a front elevation view of the design of FIG. 8.
Figure 12:
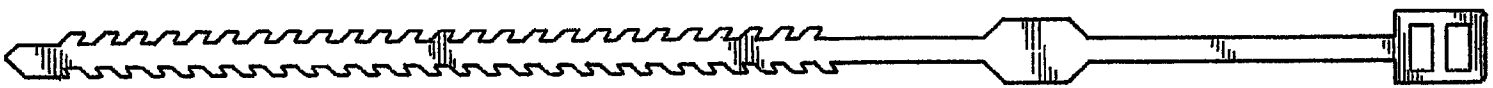
FIG. 12 is a bottom plan view of the design of FIG. 8.

As illustrated in FIG. 6, embodiments of the present invention provide, for example, a method 100 of using a fastener 20 to secure at least two reinforcement steel rebar rods 74. The method 100 can include positioning the at least two reinforcement steel rebar rods 74 adjacent each other, as shown at 101. The method 100 can include folding the fastener 20 around the positioned reinforcement steel rebar rods 74, as shown at 102. The method 100 can include inserting a first end portion of the fastener into one or more opening formed in the second end portion of the fastener 20, as shown at 103. That is, the method can include inserting the tail end 24 of the fastener 20 into the opening 50 formed in the buckle of the head end 28 of the fastener 20. The method 100 can include twisting rotationally with respect to the axis A the tail end 24 of the fastener 20 so that the tail end 24 engages an edge 60, 62 of the frame of the buckle of the head end 28 of the fastener 20 through one of the plurality of barbs 34, as shown at 104. The method can form a closed loop to thereby secure the at least two reinforcement steel rebar rods 74 within the closed loop.

Figure 7A:
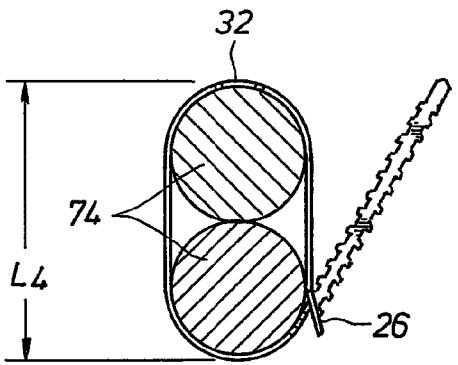
FIGS. 7A and 7B are sectional views of a fastener forming closed loops to substantially surround two rebar rods of different respective sizes of rebar rods according to embodiments of the present invention.
Figure 7B:
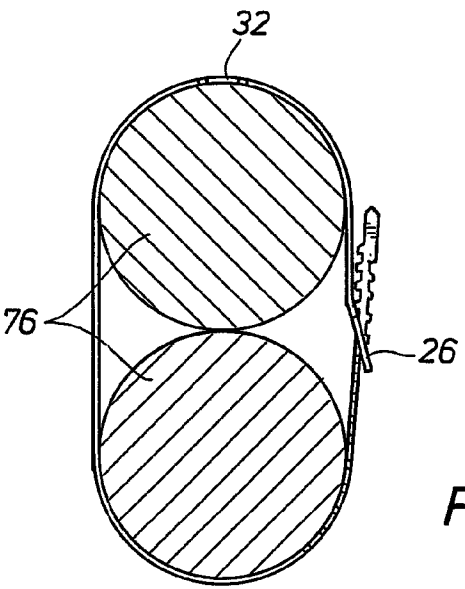

Example embodiments of a fastener, as illustrated in FIGS. 5D, 7A, and 7B, provide that the guide member 32 is positioned along the medial portion of the main body 30 of the fastener 20 so that when the located at an upper portion U of the positioned reinforcement steel rebar rods 74, 76, the guide member positions the fastener 20 so that when folded to substantially surround the at least two reinforcement steel rebar rods, the tail end 24 of the fastener 20 extends below the upper portion U of the positioned reinforcement steel rebar rods 74, 76 for a predetermined plurality of sizes of reinforcement steel rebar rods 74, 76. That is, as illustrated in FIGS. 7A and 7B, fastener 20 can secure a relatively smaller size of reinforcement steel rebar rods 74 and a relatively larger size of reinforcement steel rebar rods 76. With either relatively smaller rods 74 or relatively larger rods 76, the tail end 24 of the fastener 20 extends below the upper portion U of the positioned reinforcement steel rebar rods when the fastener is properly positioned and folded. Example embodiments of a fastener, as illustrated in FIG. 3, provide that a second length $L_2$ for the main body 30 extends along the axis A from a center C of the guide member 32 to a terminal end of the tail end 24 to thereby define a tail length $L_2$. Also, a third length $L_3$ for the main body 30 of the fastener extends along the axis A from the center C of the guide member 32 to a terminal end of the head end 28 to thereby define a head length. The tail length $L_2$ can, for example, exceed the head length $L_3$ so that when located at an upper portion U of the positioned reinforcement steel rebar rods 74, 76, the guide member 32 positions the fastener 20 so that when folded to substantially surround the at least two reinforcement steel rebar rods 74, 76, the tail end 24 of the fastener 20 extends below the upper portion U of the positioned reinforcement steel rebar rods 74, 76 for a predetermined plurality of sizes of reinforcement steel rebar rods. See, e.g., FIGS. 7A and 7B.

Example embodiments of a fastener, as illustrated in FIG. 4B, provide that the buckle of the head end 28 is substantially rectangular. In addition, a buckle width can be defined as a third width $W_3$ for the buckle in the head end 28 of the fastener 20. Example embodiments of a fastener, as illustrated in FIG. 4B, optionally provide that the opening 50 formed in the buckle of the head end 28 is a first opening and that the buckle further includes one or more second openings 52 formed in the buckle of the head end 28 of the fastener 20. An additional opening 52 can serve at least two purposes. First, an additional opening 52 can provide for various sizes of reinforcement steel rebar rods, analogous to additional notches on a belt to hold up various sizes of pants. That is, when folded to substantially surround the at least two reinforcement steel rebar rods, the tail end 24 of the fastener 20 inserts into the first opening 50 formed in the buckle of the head end of the fastener for a first predetermined size of reinforcement steel rebar rods and when folded to substantially surround the at least two reinforcement steel rebar rods, the tail end of the fastener 24 inserts into one of the one or more second openings 52 formed in the buckle of the head end 28 of the fastener 20 for a second predetermined size of reinforcement steel rebar rods to thereby allow the fastener to form the closed loop for more than one size of reinforcement steel rebar rods. Second, an additional opening 52 in a head end 28 of a fastener 20 can allow for a fastener applying tool to grasp, clasp, align, or other use the fastener 20 to secure automatically (i.e., not manually) reinforcement steel rebar rods. In an alternative embodiment as shown in FIG. 4C, the head end 28 may have a single opening 50A. The single opening 50A may optionally have substantially the same size as one of the openings 50, 52 of FIG. 4B, or up to the area of the openings 50, 52 and the space between the openings 50, 52.

The features and benefits of the embodiments of a fastener 20 as described herein include structures that enable a fastener applying tool to secure automatically, i.e., not manually, reinforcement steel rebar rods. A fastener applying tool using the fastener embodiments of the present invention has improved ergonomics over manual solutions, increased efficiency, and the ability to repetitively and serially apply fasteners. For example, a fastener applying tool can use the guide member 32 and also any additional opening 52 in the head end 28 of the fastener 20 to apply the fastener 20. For example, that the fastener 20 can be substantially flat provides that stacks of fastener embodiments can be stored, transported to a job site, and deployed efficiently, perhaps in a cartridge or other bundling mechanism useful to an automatic fastener applying tool.

The features and benefits of the embodiments of a fastener 20 as described herein include structures for use with a plurality of predetermined sizes of reinforcement steel rebar rods 74, 76 and for generating a taut fit. That is, a job site using multiple sizes of reinforcement steel rebar rods may require an inventory of only a single, or perhaps a few sizes, of fasteners because of these features and embodiments. For example, the plurality of barbs 34 of the tail end 24 of the fastener can allow for various sizes of reinforcement steel rebar rods and also provides tolerances for the rods and their placement and positioning. For example, an additional opening 52 in the head end 28 of the fastener 20 can allow for various sizes of reinforcement steel rebar rods to be secured by a fastener 20 as described herein. For example, the guide member 32, as illustrated in FIGS. 7A and 7B, can allow the fastener to secure a relatively smaller size of reinforcement steel rebar rods 74 and a relatively larger size of reinforcement steel rebar rods 76. For example, the tail length $L_2$ and head length $L_3$, as illustrated in FIG. 3, can support a predetermined plurality of sizes of reinforcement steel rebar rods.

The embodiments of a fastener 20 as described herein include that the fastener be able to bend, in order to fold around the reinforcement steel rebar rods 74. In addition, the embodiments of a fastener 20 include the ability to be rotationally twisted as described herein. Moreover, the embodiments of the tail end 24 of the fastener 20 where the tail end 24 engages a an edge 60, 62 of the frame of the buckle of the head end 28 of the fastener 20 through one of the plurality of barbs 34 to form a closed loop to thereby secure the at least two reinforcement steel rebar rods 74 requires a certain strength of the barb 34 and a rigidity for the twisted main body 30. That is, the main body 30 of the fastener 20 twists to secure the closed loop, but then does not twist back, resulting in a lasting snug or taut fit. As such, fastener embodiments can include steel, coated steel, dead soft steel, other material (including ferrous and non-ferrous material), and some plastics, but not all plastics are suitable as being either insufficiently strong or inflexible as described herein. As understood by those skilled in the art, weak materials, unable to secure the reinforcement steel rebar rods and support a surrounding concrete structure, are insufficiently strong for fastener embodiments as described herein. As understood by those skilled in the art, materials that bend too easily, such as certain soft plastics, may be ill suited for fastener embodiments as described herein, especially if the material tends to bend back to a starting shape and, thus, unlock the locking mechanism embodiments of the present invention. Likewise, inflexible or rigid materials, such as ceramics or certain hard plastics are ill suited for fastener embodiments as described herein, such materials being unable to satisfy folding and twisting embodiments of the present invention. In addition, while fastener embodiments have been described in terms of components, for example, barbs 34, main body 30, guide member 32, and head end 28, it will be understood by those skilled in the art that a fastener can be molded as a single body of plastic, stamped as a single body of steel, or otherwise formed as a single composition having the components described herein. Moreover, fastener embodiments include features and structures to enable such composition, such as, for example, the fastener being substantially flat or having lengths, widths, and angles as described herein.

As understood by those skilled in the art, the worker would prefer the fastener to be as light as reasonably possible so that many fasteners can be carried at one same time to reduce resupply efforts. Applicant submits that weight and not bulk can be the limiting factor for a worker carrying fastener embodiments as described herein; other solutions can limit the worker due to their bulk, which can affect worker efficiency and the expensive of use. Lighter embodiments, furthermore, are generally less expensive because such fasteners use less material, e.g., less steel. Moreover, the compact size of the fastener embodiments allow for a cartridge or other embodiments of group of fasteners to be used by a worker. As such, fastener embodiments for metal materials can include a range of thickness from 0.020 inches to 0.080 inches. For metal fastener embodiments thinner than 0.020 inches, lack of strength becomes an issue. For metal fastener embodiments thicker than 0.080 inches, inflexibility, expense, and weight become issues. In addition, a thick metal fastener embodiment can necessitate larger dimensional spacing for the design as understood by those skilled in the art.

In an example embodiment, tail width $W_1$ of the fastener 20 can be 0.136 inches, the opening width $W_2$ of the fastener 20 can be 0.140 inches, the buckle width $W_3$ of the fastener 20 can be 0.254 inches, a medial width $W_4$ can be 0.075 inches, a guide width $W_5$ can be 0.225 inches, and a barb width $W_6$ can be 0.0305 inches. In an example embodiment, opening length $L_1$ can be 0.082 inches, the tail length $L_2$ can be 3.805 inches, and the head length $L_3$ can be 1.700 inches. In an example embodiment, the predefined angle $\theta_1$ from the axis A is 45 degrees; the predefined angle for the transverse edges of the guide member with the axis A is defined as $\theta_2$ and is 135 degrees. In an example embodiment, the thickness of the fastener is 0.042 inches. In an example embodiment, tolerances can generally be +/−0.015 inches, as understood by those skilled in the art.

In an example embodiment, a fastener 20 embodiment can be formed out of a sheet (or roll) of dead soft steel using a high-speed stamping machine as understood by those skilled in the art. Dead soft steel is steel that is very low in carbon and has been annealed until it is soft and malleable. The high-speed stamping machine uses a die to make the necessary cuts simultaneously in one action as understood by those skilled in the art. In an example embodiment, multiple fasteners, i.e., a batch of fasteners, can be stamped out of a single sheet of dead soft steel. As such, embodiments can be manufactured using conventional processes and inexpensive materials. In addition, steel embodiments can be treated with a rust-inhibiting coating to avoid rust and maintain strength. An additional benefit of such coating embodiments is that coated embodiments may have a visibly distinct color that contrasts with typically dark reinforcement steel rebar rods. The color difference can allow for easy verification (if a rod intersection is overlooked) and also for improved efficiency when positioning the guide member 32.

Many modifications and other embodiments of the invention will come to the mind of one skilled in the art having the benefit of the teachings presented in the foregoing descriptions and the associated drawings. Therefore, it is to be understood that the invention is not to be limited to the illustrated embodiments disclosed, and that modifications and other embodiments are intended to be included within the scope of the appended claims.

That claimed is:

1. A fastener to secure rebar rods comprising:

a substantially planar elongate and metallic main body having a first end portion, a second end portion, a third portion extending between the first end portion and the second end portion to define a medial portion, and a centerline substantially parallel to a length of the elongated main body;

an opening having an opening length and an opening width and being formed through the first end portion so that the first end portion and the opening collectively define a head end having a width greater than a width of the medial portion, the opening length extending in the same direction as the length of the elongate main body and the opening width extending in a direction substantially orthogonal to the opening length, the opening length being less than the opening width; and at least two pairs of barbs, each pair of the at least two pairs of barbs depending from opposing lateral edges of the second end portion, each of the barbs of the at least two pairs of barbs having a lagging surface oriented oblique to the centerline and generally facing the head end, and each of the barbs of the at least two pairs positionally staggered along a length of the lateral edges as compared to another barb of the at least two pairs of barbs, the distance from a distal end of each barb of the at least two pairs of barbs extending to an opposing lateral edge defining a first barb end width and the distance from the distal end of each barb of the at least two pairs of barbs along one of the lateral edges to the distal end of each barb of the at least two pairs of barbs along the opposing lateral edge being a second barb end width, the first barb end width being less than the opening width and the second barb end width being greater than the opening width so that when the elongate main body is wrapped around the rebar rods and the second end portion is inserted through the opening and substantially aligned with the opening width the second end portion undulatingly inserts through the opening and so that when the elongate main body twistingly rotates about the centerline when the second end portion is inserted in the opening, the twist from the rotation produces an interference between the lagging surface and a length of a lateral edge of the opening to thereby retain the fastener around the rebar rods.

2. A fastener of claim 1, wherein the at least two pairs of barbs comprises a plurality of barbs extending along the main body from the second end portion toward a head opening to define a body barb-extending length, and wherein the body barb-extending length has a length that is greater than a length of a portion of the medial portion between the body barb-extending length and a head, and wherein the portion of the medial portion between the body barb-extending length and the head defines a non-barb extending length of the main body.

3. A fastener of claim 1, wherein a first width of a tail end of the fastener extends in a lateral direction from a distal end of a first barb to a distal end of a second barb, the second barb being positioned on an opposite lateral side of the main body from the first barb to thereby define a tail width; and wherein the opening width exceeds the tail width so that the tail end of the fastener inserts into the opening.

4. A fastener of claim 3, further comprising a buckle in the head end and wherein the tail width exceeds the opening length so that when inserted in the head end of the fastener and then twisted rotationally with respect to the centerline, the tail end of the fastener engages the head end of the fastener to thereby prevent a withdraw of the tail end.

5. A fastener of claim 1, wherein a predefined angle from the centerline to a leading surface on the barbs is between about 30 and 60 degrees.

6. A fastener of claim 4, wherein the tail end being twisted rotationally with respect to the centerline is rotated between about 30 degrees and about 105 degrees at the one of the plurality of barbs of the tail end of the fastener that engages the buckle to form a closed loop.

7. A fastener of claim 1, wherein a fourth width for the medial portion of the main body extends in a lateral direction from opposing lateral edges of the medial portion to define a medial width;

wherein the fastener further comprises a first aligning tab that is substantially flat and a second aligning tab that is substantially flat, each of the first and second aligning tabs also having a proximal end adjacent and connected to the medial portion of the main body and a distal end being distal from the medial portion of the main body, wherein the first aligning tabs extends outwardly in a lateral direction opposite a lateral direction than the second aligning tab, so that the first and second aligning tabs and an integrally formed section of the medial portion together define a guide member, wherein the guide member is spaced axially away from the first end portion and the second end portion; and wherein a fifth width for the guide member extends in a lateral direction from the distal end of an aligning tab to a distal end of the opposite aligning tab to thereby define a guide width, the guide width exceeding the medial width.

8. A fastener of claim 7, wherein the guide member is positioned along the medial portion, so that when the guide member is located at an upper portion of the rebar rods, the guide member positions the fastener so that when the fastener is folded to substantially surround the at least two rebar rods, the tail end extends below an upper portion of the rebar rods for a predetermined plurality of sizes of rebar rods.

9. A fastener of claim 1, further comprising a substantially rectangular buckle formed on the head end;

wherein the opening is formed in the buckle and is a first opening; and wherein the buckle further comprises one or more second openings formed in the buckle of a head end of the fastener so that when the main body is folded to substantially surround the rebar rods, a tail end of the fastener inserts into the first opening for a first predetermined size of rebar rods, and so that when folded to substantially surround the rebar rods, the tail end of the fastener inserts into one of the one or more second openings formed in the buckle of the head end of the fastener for a second predetermined size of rebar rods to thereby allow the fastener to form a closed loop for more than one size of rebar rods.

10. A fastener of claim 2, wherein each of the plurality of barbs has a substantially parallelogram shape and has rounded corners adjacent where the lagging surface adjoins a leading surface.

11. A method of fastening rebar rods comprising:

a. providing a fastener comprising a substantially planar elongate and metallic main body having a first end portion, a second end portion, a third portion extending between the first end portion and the second end portion to define a medial portion, and a centerline substantially parallel to a length of the elongated main body; an opening formed through the first end portion having an opening length and an opening width and formed through the first end portion so that the first end portion and the opening collectively define a head end having a width exceeding a width of the medial portion, the opening length extending in the same direction as the length of the elongate main body and the opening width extending in a direction substantially orthogonal to the length, the opening length being less than the opening width; and at least two pairs of barbs, each pair of the at least two pairs of barbs depending from opposing lateral edges of the second end portion, each of the barbs having a lagging surface oriented oblique to the centerline and generally facing the head end and each of the barbs of the at least two pairs positionally staggered along a length of the lateral sides as compared to another barb of the at least two pairs of barbs, the distance from a distal end of each barb of the at least two pairs of barbs extending to an opposing lateral edge defining a first barb end width and the distance from the distal end of each barb of the at least two pairs of barbs along one of the lateral edges to the distal end of each barb of the at least two pairs of barbs along the opposing lateral edge being a second barb end width, the first barb end width being less than the opening width and the second barb end width being greater than the opening width;

b. folding the main body around the rebar rods when the rebar rods are positioned transverse to one another;

c. inserting a free end of the second end portion into the opening; and d. twisting the main body so that at least one of the barbs rotate about the centerline and into interfering engagement with an edge of the opening length thereby securing the fastener around the rebar rods.

12. A method of claim 11, wherein the plurality of barbs each respectively have a lagging surface generally facing the head end and a leading surface generally facing away from the head end, the lagging surface of each of the plurality of barbs extending obliquely with respect to the centerline;

wherein each of the plurality of barbs also has a proximal end adjacent and connected to the second end portion of the main body and a distal end being distal from the second end portion of the main body, the plurality of barbs being staggered on opposite lateral edges of the main body.

13. A method of claim 11, wherein a first width of a tail end of the body extends in a lateral direction from the distal end of a first barb to the distal end of a second barb, the second barb being positioned on an opposite lateral edge of the body from the first barb to thereby define a tail width; and wherein, the opening width exceeds the tail width so that the tail end of the fastener inserts into the opening.

14. A method of claim 13, wherein the tail width exceeding the opening length so that when inserted in the head end of the fastener and then twisted rotationally with respect to the centerline, the tail end of the fastener engages the head end of the fastener to thereby prevent a withdraw of the tail end.

15. A method of claim 14, wherein a predefined angle from the centerline to the lagging surface of each of the plurality of barbs is between about 30 and 60 degrees.

16. A method of claim 13, wherein the tail end being twisted rotationally with respect to the centerline is rotated between about 30 degrees and about 105 degrees at the one of the plurality of barbs of a tail end of the fastener engages an edge of the opening to form a closed loop.

17. A method of claim 11, wherein a fourth width for the medial portion of the main body extends in a lateral direction from a first lateral edge of medial portion to a second lateral edge of the medial portion positioned on an opposite side to thereby define a medial width;

wherein the fastener further comprises first and second aligning tabs that are substantially flat, wherein each of the first and second aligning tabs also having a proximal end adjacent and connected to the medial portion of the main body and a distal end being distal from the medial portion of the main body, each of the first and second aligning tabs being connected to and extending outwardly from a section of the medial portion of the main body, and wherein the each of the first aligning tabs extend from the main body in an opposite lateral direction than the second aligning tabs, so that the first and second aligning tabs and an integrally formed section of the medial portion together define a guide member; and wherein a fifth width for the guide member extends in a lateral direction from the distal end of an aligning tab to a distal end of the opposite aligning tab to thereby define a guide width, the guide width exceeding the medial width.

18. A method of claim 17, wherein the step of folding the fastener around the positioned reinforcement steel rebar rods further includes: locating the guide member at an upper portion of the positioned reinforcement steel rebar rods so that when folded to substantially surround the at least two reinforcement steel rebar rods, the tail end of the fastener extends below the upper portion of the positioned reinforcement steel rebar rods for a predetermined plurality of sizes of reinforcement steel rebar rods.

19. A method of claim 17, wherein a second length for the main body extends along the centerline from a center of the guide member to a terminal end of the tail end to thereby define a tail length; and wherein a third length for the main body of the fastener extends along the centerline from the center of the guide member to a terminal end of the head end to thereby define a head length, the tail length exceeding the head length so that when located at an upper portion of the positioned reinforcement steel rebar rods, the guide member positions the fastener so that when folded to substantially surround the rebar rods, the tail end of the fastener extends below the upper portion of the rebar rods for a predetermined plurality of sizes of rebar rods.

20. A method of claim 11, wherein a substantially rectangular buckle is in the first end and wherein the opening formed in the buckle is a first opening, and wherein the buckle further comprises one or more second openings formed in the buckle of the head end of the fastener so that when folded to substantially surround the rebar rods, a tail end of the fastener inserts into the first opening formed in the buckle of the head end of the fastener for a first predetermined size of reinforcement steel rebar rods and so that when folded to substantially surround the rebar rods, the tail end of the fastener inserts into one of the one or more second openings formed in the buckle of the head end of the fastener for a second predetermined size of rebar rods to thereby allow the fastener to form a closed loop for more than one size of rebar rods.

21. A method of claim 12, wherein each of the plurality of barbs has a substantially parallelogram shape and has rounded corners adjacent the head edge.

* * * * *